United States Patent [19]

Lutz

[11] Patent Number: 4,849,650

[45] Date of Patent: Jul. 18, 1989

[54] HYDRAULIC DRIVE FOR A HIGH-VOLTAGE SWITCHGEAR

[75] Inventor: Ferdinand Lutz, Heppenheim, Fed. Rep. of Germany

[73] Assignee: BBC Brown Boveri Aktiengesellschaft, Mannheim, Fed. Rep. of Germany

[21] Appl. No.: 174,086

[22] Filed: Mar. 28, 1988

[30] Foreign Application Priority Data

Mar. 27, 1987 [DE] Fed. Rep. of Germany ..... 3710082
Jun. 5, 1987 [DE] Fed. Rep. of Germany ..... 3718869

[51] Int. Cl.[4] ..... H01H 35/18; H01H 35/38; H01H 33/82

[52] U.S. Cl. ..... 307/118; 200/82 B; 200/148 B

[58] Field of Search ..... 307/118; 200/82 B, 148 B

[56] References Cited

U.S. PATENT DOCUMENTS

| | | | |
|---|---|---|---|
| 2,783,338 | 2/1957 | Beatty | 200/148 D |
| 3,075,060 | 1/1963 | Strom | 200/82 B |
| 3,110,783 | 11/1963 | Strom et al. | 200/82 B |
| 3,646,292 | 2/1972 | Barkan et al. | 200/82 B |
| 3,823,286 | 7/1974 | Thurk et al. | 200/82 B |
| 3,885,113 | 5/1975 | Barkan et al. | 200/82 B |
| 4,009,358 | 2/1976 | Gratzmuller | 200/150 B |
| 4,413,166 | 11/1983 | Meyer | 200/148 B |

FOREIGN PATENT DOCUMENTS

| | | |
|---|---|---|
| 1807590 | 11/1969 | Fed. Rep. of Germany . |
| 1807591 | 11/1969 | Fed. Rep. of Germany . |
| 2631194 | 2/1978 | Fed. Rep. of Germany . |
| 2901872 | 7/1980 | Fed. Rep. of Germany . |
| 3544142 | 6/1986 | Fed. Rep. of Germany . |

*Primary Examiner*—William M. Shoop, Jr.
*Assistant Examiner*—Sharon D. Logan
*Attorney, Agent, or Firm*—Herbert L. Lerner; Laurence A. Greenberg

[57] ABSTRACT

A high-voltage switchgear having a fixed and a moving contact member includes a hydraulic drive for operation of the moving contact member having a piston and cylinder configuration with a piston coupled to the moving contact member. A fluid reservoir configuration supplies fluid under pressure to the piston for driving the piston. A compressor unit at ground potential charges the fluid reservoir configuration. Electrically-insulating, pressure-resistant lines respectively connect the compressor unit with the piston and cylinder configuration and with the fluid reservoir configuration. The piston and cylinder configuration and the fluid reservoir configuration are disposed spatially close to and at the same electrical potential as the moving contact member.

19 Claims, 5 Drawing Sheets

HYDRAULIC DRIVE FOR A HIGH-VOLTAGE SWITCHGEAR

The invention relates to a hydraulic drive for operation of the moving contact member of a high-voltage switchgear, including a piston and cylinder configuration, the piston of which is coupled to the moving contact member, a fluid reservoir configuration from which fluid under pressure can be conveyed to the piston for driving the piston, and a compressor unit for charging the fluid reservoir configuration.

High-voltage circuit-breakers are, inter alia, operated by hydraulic drives which have a piston and cylinder configuration, the piston of which is connected or coupled to the moving contact member of the power switchgear. The hydraulic drive lies mostly outside the metal casing or outside the breaker pole, and it is usually at ground potential. The connection between the piston rod and the moving switch contact member of the circuit-breaker is provided by insulating drive rods and possibly other mechanical transmission members. All of these transmission members have to be formed in such a way that acceleration and braking of the contact pin is possible without play. Consequently, the expense for constructing such a circuit-breaker is relatively high.

It is accordingly an object of the invention to provide a hydraulic drive for a high-voltage switchgear, which overcomes the hereinafore-mentioned disadvantages of the heretofore-known devices of this general type and in which the expense for mechanical construction is reduced.

With the foregoing and other objects in view there is proivded, in accordance with the invention, in a high-voltage switchgear having a fixed and a moving contact member, a hydraulic drive for operation of the moving contact member, comprising a piston and cylinder configuration having a piston coupled to the moving contact member, a fluid reservoir configuration supplying fluid under pressure to the piston for driving the piston, a compressor unit at ground potential for charging the fluid reservoir configuration, and electrically-insulating, pressure-resistant lines respectively connecting the compressor unit with the piston and cylinder configuration and with the fluid reservoir configuration, the piston and cylinder configuration and the fluid reservoir configuration being disposed spatially close to and at the same electrical potential as the moving contact member.

According to the invention, the piston and cylinder configuration is therefore at high-voltage potential, as is the energy storage device, and only the control pulses for the drive and for the processing of the signals coming from the drive which, for example, indicate the setting of the switch, are processed at ground potential. In this way, there is a reduction in one of the structural expenses of the drive, because on one hand relatively long transmission rods of insulating material can be dispensed with, and on the other hand the structural size of the switchgear is significantly reduced. It is no longer necessary to join the whole drive housing onto a coupling flange which has to be separately provided.

The particular advantage of the apparatus according to the invention appears from the following considerations:

For every switching action, sufficient energy must be supplied for acceleration of all of the masses that are moved as well as for quenching arcs. Accordingly, the total energy is $$E_{SH}=\tfrac{1}{2}M_1\cdot V_1^2+M_2\cdot V_2^2+M_3\cdot V_3^2)+E_L$$

Where:

$E_{SH}$=energy of the switching action, $M_1$=moving mass of the drive, $M_2$=moving mass of the transmission rod, $M_3$=moving mass of the switch (switch contact member, blast piston etc.), $E_L$=energy of the arc quenching, and $V_i$=speed of the mass $M_i$ (i=1, 2, 3).

In the apparatus according to the invention, the hydraulic drive is at high-voltage potential and the distance between the piston and the switch contact member is thus significantly reduced. Therefore, the transmission rods can be dispensed with and $M_2$ becomes 0. The small energy to be supplied from the drive permits a smaller construction, so that $M_1$ is reduced. The hydraulic drive can thus be further reduced in size, and therefore improved.

In accordance with another feature of the invention, there are provided hydraulic actuators or valves for the fluid reservoir unit and for the drive piston, and an electronic control unit for setting the hydraulic actuators and for processing and transmitting control signals, the electronic control unit being spatially close to and at the same high-voltage potential as the moving contact member. In this way, long control paths are advantageously omitted.

In accordance with a further feature of the invention, there is provided an electrical storage device such as a battery being in spatial proximity to the electronic control unit and at high-voltage, potential, for supplying power to the electronic control unit and for setting the the hydraulic actuators.

In accordance with an added feature of the invention, there is provided a control energy supply unit at ground potential, means for directly transmitting energy, or an electrically-insulating glass fiber cable transmitting energy, for supplying the electronic control unit, for setting the hydraulic actuators and optionally for charging the electrical storage device as light energy from the control energy supply unit to high-voltage potential, and means at high-voltage potential for converting the light energy into electrical energy.

It is thus seen that the signals conveyed to the control unit and the signals originating from the control unit are light signals which are conveyed to or from the control unit through glass fiber cables or directly by a light beam, while the driving energy is transmitted as light energy and is converted into electrical energy by means of a photocell configuration, and serves either for driving the control unit directly or for charging an electrical storage device or accumulator, the energy content of which is then used for electrical supply to the control unit.

In accordance with an additional feature of the invention, there is provided a central control configuration at ground potential, and electrically insulating glass fiber cables for transmitting light signals generated by the central control configuration to the electronic control unit and for transmitting light signals generated by the electronic control unit to the central control configuration.

In accordance with yet another feature of the invention, there is provided a central control configuration at ground potential, and means for directly transmitting light signals generated by the central control configuration to the electronic control unit across an electrically insulating gas gap and for directly transmitting light signals generated by the electronic control unit to the central control configuration across the electrically insulating gas gap.

In the apparatus according to the invention, a compressor unit is provided at ground potential and is connected to the piston and cylinder configuration and to the fluid reservoir configuration through electrically-insulating, pressure-resistant hydraulic lines. In order to set the valves which are at high-voltage potential, the control unit is at high-voltage potential. The control unit requires electrical energy just like the valves, which is to be drawn from a battery or accumulator that is at high-voltage potential, as mentioned above, and is charged through optical glass fiber lines or through directly-beamed light with a photovoltaic element downstream thereof.

However, only relatively low energy levels can be transferred from ground potential to high-voltage potential by light and through glass fiber lines, and the charging procedure for the battery then takes a long time.

In accordance with yet a further feature of the invention, there is provided an electric generator at high-voltage potential disposed spatially close to the moving contact member, a hydraulic motor at high-voltage potential driving the electric generator, the electrically-insulating, pressure-resistant lines lines carrying pressure fluid conveyed from ground potential to high-voltage potential driving the hydraulic motor and charging the electrical storage device.

This structure is provided in order to improve the charging procedure and additionally to increase the capacity of the battery. The result of using such a structure is that greater energy levels which may possibly be necessary can be conveyed from ground potential to high-voltage potential more simply with the help of hydraulic lines than with optical glass fiber lines. Therefore, an accumulator with higher capacity can be employed, or there is the possibility of charging the battery in a shorter time than in the prior art.

In order to drive the hydraulic motor, the same pressure fluid can be employed as that which is used for operation of the contact member of the switchgear, i.e. the fluid which fills the hydraulic reservoirs. At the same time, the pump at ground potential could also be supplemented redundantly by a second pump, which has the same output as the main pressure fluid pump. The second pump can also only be constructed in such a way that it just suffices for driving the hydraulic motor.

In accordance with yet an added feature of the invention, there is provided a current sensor electrically conductingly connected to the the electronic control unit for controlling operation of the moving contact member triggered by the electronic control unit in time synchronization with current flow.

Since the drive is spatially directly associated with the circuit-breaker contact, it is divided into one drive for each phase. Therefore, the operation of the "partial drives" for each phase can be matched to the phase condition of the current in the associated conductor. The energy required for synchronous switching corresponding to the phase condition is significantly less than that which has to be supplied if the switch must operate independently of the phase condition. Accordingly, the compression or gas pistons can be made smaller and thus the mass $M_3$ of the switch to be accelerated in the above-stated formula is also reduced.

According to the invention, the switch drive becomes smaller because it is associated spatially with the switching contact pin and it is at the same potential as the pin. It can thus be located there because it has become smaller.

In accordance with yet an additional feature of the invention, there is provided a conductor at high-voltage potential having an interior, the piston and cylinder configuration, the fluid reservoir configuration, the electronic control unit and preferably the electrical storage device being disposed in the interior of the conductor.

In accordance with again another feature of the invention, there is provided a conductor at high-voltage potential having an interior, the pistion and cylinder configuration, the fluid reservoir configuration, the electronic control unit and preferably the electrical storage device being disposed in the interior of the conductor, a metal casing surrounding the conductor, and a supporting insulator disposed between the conductor and the metal casing, the glass fiber cable being conducted through the supporting insulator from high-voltage potential to ground potential.

In accordance with again a further feature of the invention, there is provided a conductor at high-voltage potential having an interior, the piston and cylinder configuration and the fluid reservoir configuration being disposed in the interior of the conductor, a metal casing surrounding the conductor, and a supporting insulator disposed between the conductor and the metal casing, the the electrically-insulating, pressure-resistant lines lines being in the from of a hydraulic pressure line and a return line conducted through the supporting insulator.

In accordance with again an added feature of the invention, the fluid reservoir configuration includes a plurality of reservoirs corresponding to a given number of required switching actions.

In accordance with a concomitant feature of the invention, the hydraulic drive is for an open-air switch and there is provided a supporting insulator supporting the piston and cylinder configuration, the fluid reservoir configuration and the electronic control unit, and an insulating supply conduit parallel to the supporting insulator, the electrically-insulating, pressure-resistant lines and the electrically insulating glass fiber cables being disposed inside the insulating supply conduit.

Other features which are considered as characteristic for the invention are set forth in the appended claims.

Although the invention is illustrated and described herein as embodied in a hydraulic drive for a high-voltage switchgear, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

All five of the figures are very diagrammatic and individual details and structural peculiarities of the switch are not shown. Moreover, it should also be stressed that the configurations shown in FIGS. 1 to 4 are shown as single-phase devices. However, it is also possible to employ the invention in three-phase switchgears in a casing without difficulty. In any such case, the configurations shown in FIGS. 1 and 2 would be provided three times in one casing.

Figure 1:
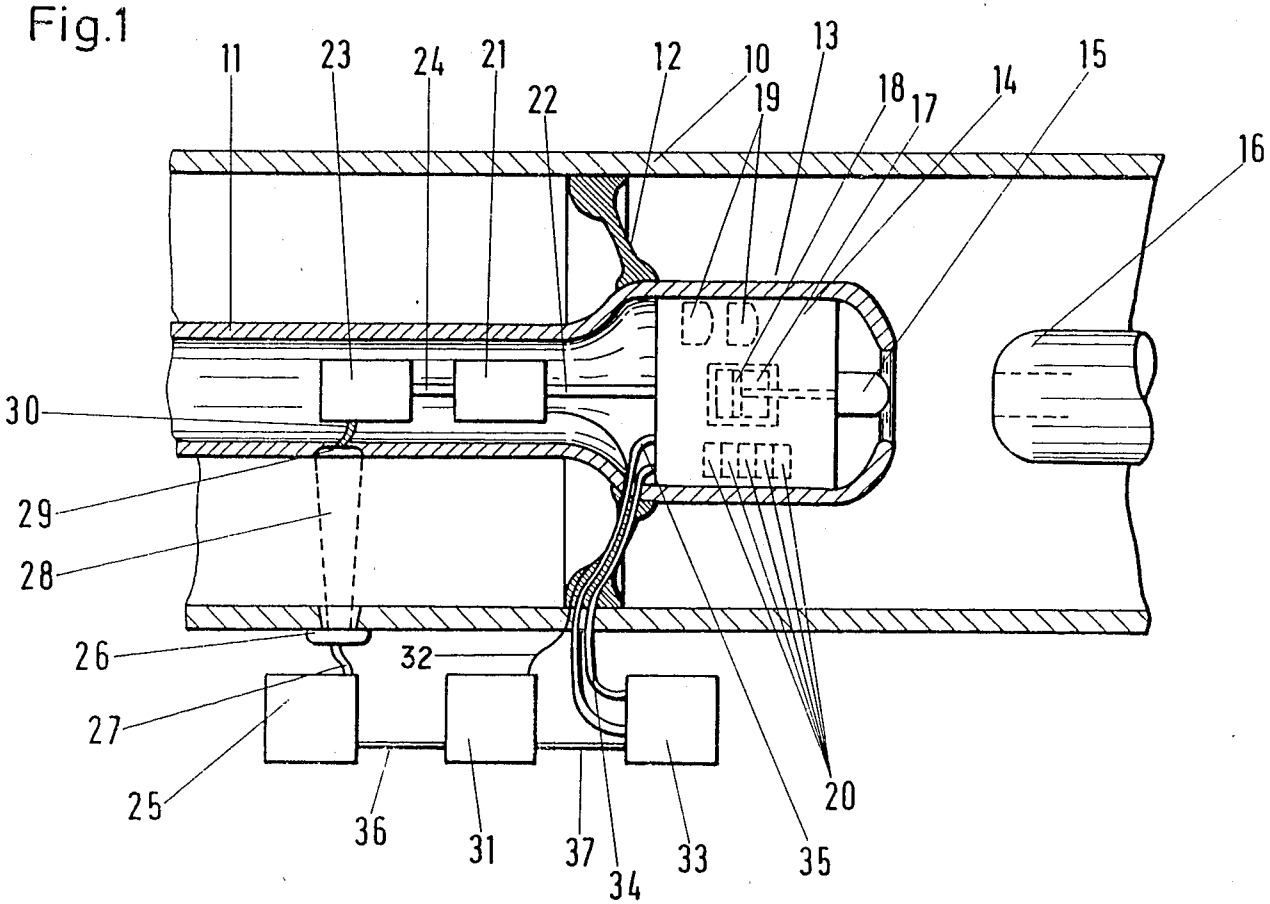
FIG. 1 is a fragmentary, diagrammatic, cross-sectional view of a single-phase embodiment of a switch drive according to the invention.

Referring now to the figures of the drawings in detail and first, particularly, to FIG. 1 thereof, there is seen a metal casing 10 in which a hollow conductor 11 at high-voltage potential is held in place within the metal casing 10 by means of a disc-shaped supporting insulator 12. The supporting insulator 12 can naturally also be a segregating insulator.

The hollow conductor 11 has a region 13 with an enlarged diameter at one end thereof, in which a drive unit 14 is housed. The drive unit 14 drives a moving switch contact member 15, which cooperates with a fixed switch contact member 16, constituting a high-voltage circuit-breaker. The drive unit 14 includes a piston and cylinder configuration 17, the piston 18 of which is coupled to the moving switch contact member 15. Furthermore, the interior of the drive unit 14 contains reservoirs 19 for pressure fluid through which the piston and cylinder configuration 17 is operated or driven in order to carry the moving switch contact member into the on or off position. For this purpose, in the configuration according to FIGS. 1 and 2, respective reservoirs are provided for switching on and switching off. Both the piston and cylinder configuration and the reservoirs 19 are set by means of electrically-operated valves or hydraulic actuators 20.

In the interior of the hollow conductor 11 and close to the region 13 with enlarged diameter, is a control unit 21 having output signals which are conveyed through a line 22 to the drive unit 14, in order to set the valves 20. In the interior of the hollow conductor 11 there is also an electrical storage device 23, in the form of a battery which supplies the control unit 21 with electrical energy through a line 24.

The drive unit 14 is a unitary block, in which all the components necessary for operation of the moving contact member are disposed.

The charging of the electrical storage device 23 is effected by a charging unit or control energy supply unit 25, which supplies an optical trasmitter unit 26 through a line 27. Light which is produced in the optical transmitter unit 26 is conveyed through a beam 28 to a photocell 29, in which the light energy is converted into electrical energy and conveyed through a line 30 to the electrical storage device 23.

A central control module or configuration 31 is provided at ground potential, from which control signals are conveyed to the control unit 21 through a glass fiber line 32. The central control module 31 is also connected with a compressor unit 33 and the charging unit 25 through the lines 36, 37. Thus, the compressor unit 33 at ground potential conveys fluid under pressure through a pressure-resistant hydraulic line 34 to the drive unit 14 and from there to the reservoirs 19. A return line 35 runs parallel to the line 34 for returning used fluid from the reservoirs 19 and from the piston and cylinder configuration 17, respectively, to the compressor unit.

As can therefore be seen from FIG. 1, all the essential parts of the switch and also of the drive are at high-voltage potential, so that a substantial simplification of the construction and a substantial reduction of dimensions are achieved. The energy necessary for operation of the switch, that is for operating the moving switching contact pin, is reduced to a minimum.

The supply line 34 as well as the return line 35 and the control line 32 are led through the supporting insulator 12 from ground potential to high-voltage potential.

Figure 2:
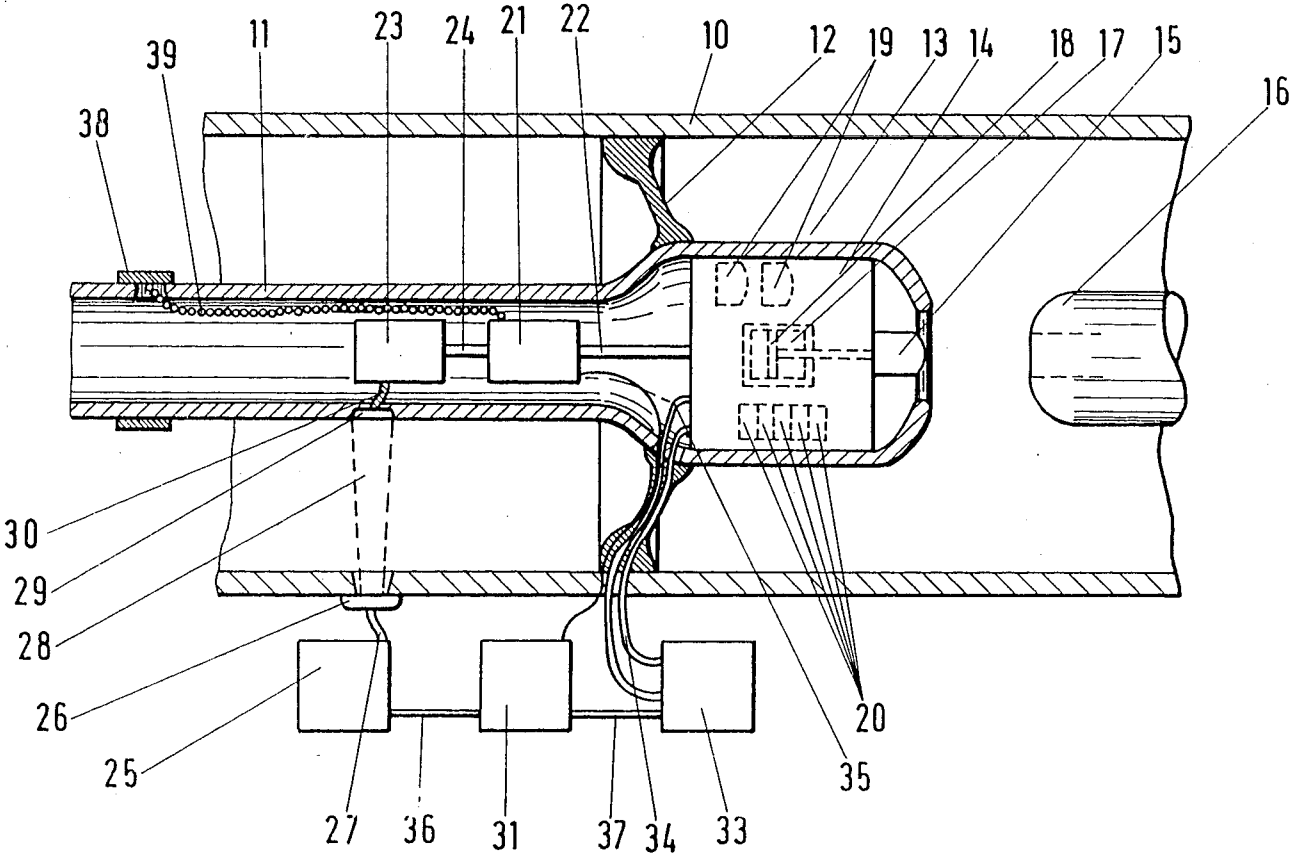
FIG. 2 is a view similar to FIG. 1 of a further configuration of the switch drive.
Figure 3:
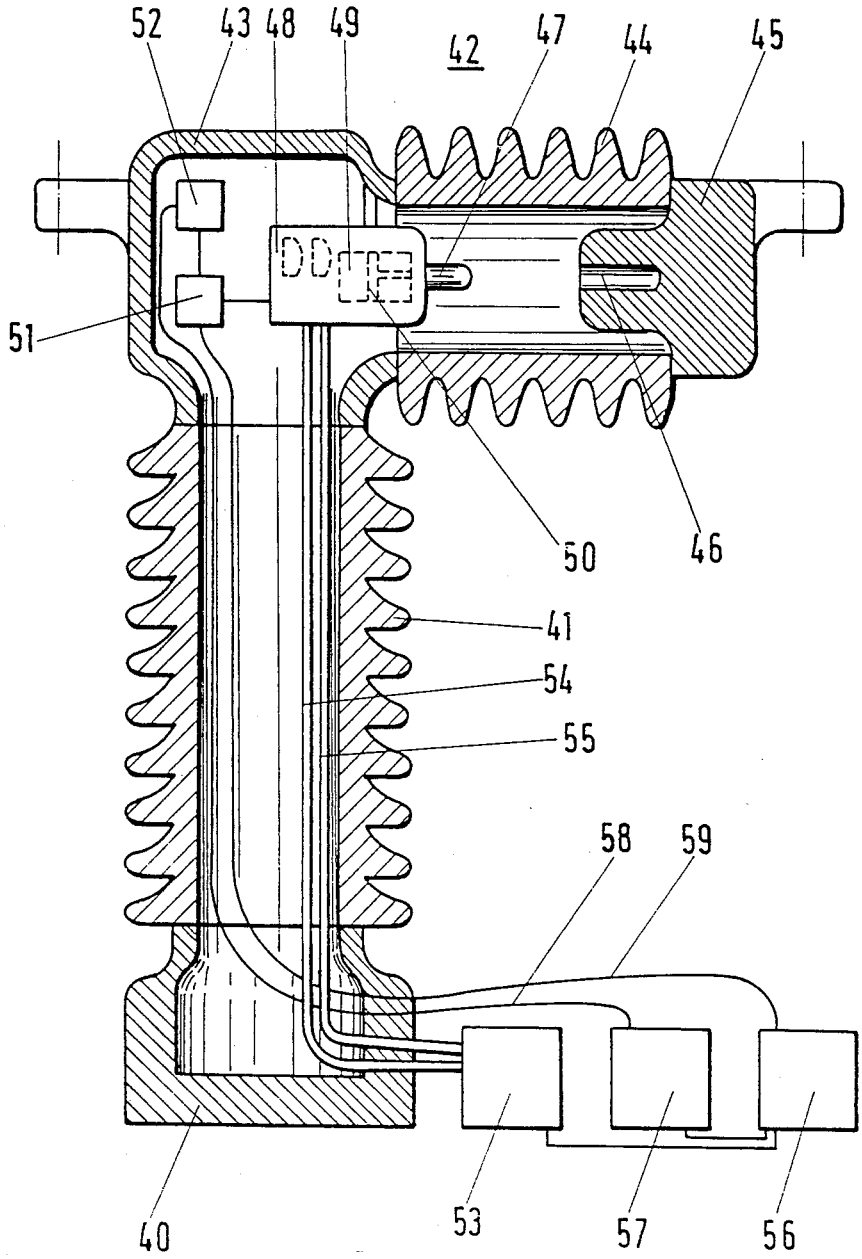
FIG. 3 is a longitudinal-sectional view of an open air switch.

FIG. 2 shows an advantageous configuration of the switch according to FIG. 1. A current sensor 38 which is disposed around the hollow conductor 11 is connected to the control unit 21 by a connecting line 39. This disposition of the current sensor 38 applied to the conductor 11 is able to cause the operation of the drive piston 18 triggered by the control unit 21 to occur in timed synchronization with the flow of current, so that the switchgear according to FIG. 2 is a synchronous switch. A Rogowski coil may, for example, be used as the current sensor 38.

The configuration according to the invention, that is the application of the drive to the high-voltage conductor, is described in FIGS. 1 and 2 with reference to a switch which is gas-insulated with SF6, and is in a metal casing. The concept of the invention can also be put to use in an open-air or outdoor switch, as can be seen from FIG. 3 and FIG. 4. This outdoor switchgear has a base portion 40, on which a supporting insulator 41 is fixed and constructed and which supports a switch unit 42 and insulates it from ground potential. The switch unit includes a first housing 43, onto which an insulating intermediate member 44 is joined. The insulating intermediate member 44 has a tubular shape and extends transversely to the longitudinal axis of the supporting insulator. A cover of electrically conducting material 45 is fixed to the free end surface of the insulating intermediate member. A fixed contact member 46 integrated in the cover 45 and a moving contact member 47 are disposed in the interior of the switching part 42, and in fact they are disposed in the vicinity of the insulating intermediate member 44. The moving contact member 47 is connected to a hydraulic drive unit 48, which has a piston and cylinder configuration 49 with a piston 50 coupled to the moving contact member 47.

A control unit 51 corresponding to the control unit 21 and a battery unit 52 corresponding to the battery unit 23 feeding or supplying the control unit, are disposed in the interior of the housing 43. A compressor unit 53 at ground potential is connected to the drive unit 48 through a supply line 54 and a return line 55. A central control module or configuration 56 sets the control unit 51, and the battery 52 is supplied with energy by means of an energy supply configuration or control energy supply unit 57 through a glass fiber line 58. The unit 57 emits light, which is converted into electric current by a photocell in the battery unit 52. A line 59, through which the central control configuration 56 sets the control unit 51, is also in the form of a glass fiber line.

Figure 4:
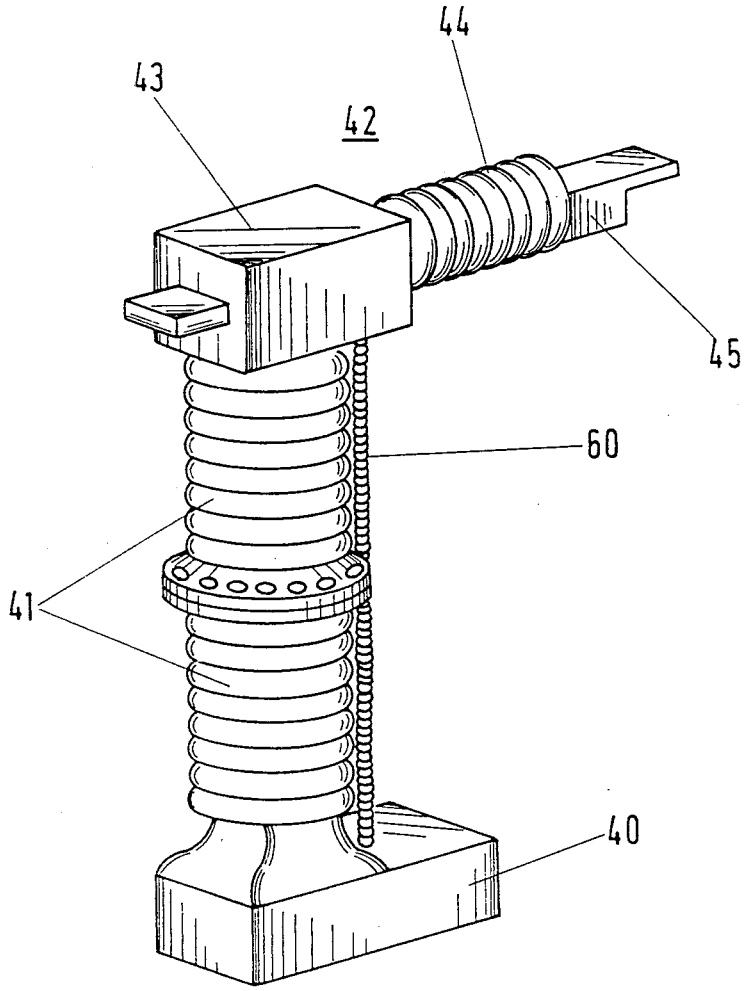
FIG. 4 is a perspective view of an open-air switch.

In an advantageous configuration according to FIG. 4, the fluid lines 54, 55 as well as the glass fiber lines 58, 59 provided for transmission of contol power and of control information, are guided inside a supply conduit 60 running parallel to the supporting insulator 41. In this way, the expense involved in installation can be reduced advantageously, especially if the supporting insulator 41 is subdivided for high voltage levels, and if possible the supporting insulator is not mounted on the switch 42 until it is in situ.

The drive described above, with a plurality of reservoirs separated from each other and determined as to number by the number of necessary switching actions, can naturally also be at high-voltage potential, since due to the direct proximity to the moving contact member and due to the smaller construction required thereby, it has enough space at high-voltage potential for operation of smaller masses. In the embodiments described above however, the energy for charging the battery is supplied through glass fiber lines or through direct light radiations.

Figure 5:
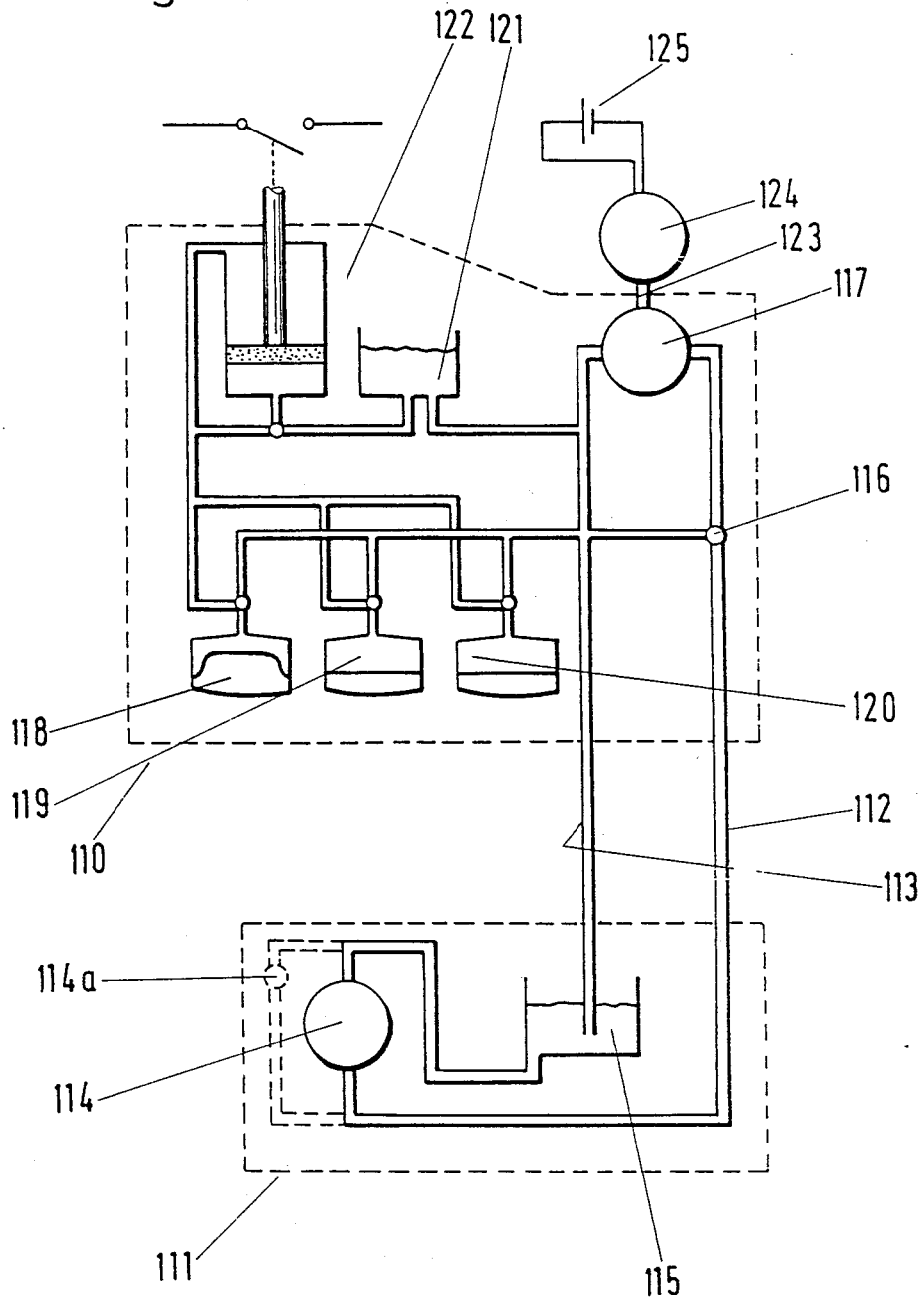
FIG. 5 is a diagrammatic and schematic circuit diagram illustrating the principle of an embodiment of a hydraulic switch drive according to the invention.

In FIG. 5, the components of the circuit-breaker drive according to the invention are combined into two main blocks 111 and 110. One block 111 is at ground potential and the other block 110 is at high-voltage potential. The two blocks 110 and 111 are connected together through two electrically-insulating high-pressure hydraulic lines 112 and 113. A pump 114 and a low-pressure tank 115 are disposed in the main block 111, which is at ground potential. The pump 114 transports fluid under pressure through the high-pressure hydraulic line 112 to high-voltage potential, where the fluid can either drive a hydraulic motor 117 or serve to change one of three reservoirs 118, 119 and 120, depending on the setting of a multiway valve 116. Exhaust fluid from a piston and cylinder configuration 122 of the drive flows into a low-pressure tank 121 at high-voltage potential. The return flow of the exhausted fluid both from the hydraulic motor 117 as well as from the low-pressure tank 121, takes place through the high-pressure hydraulic line 113. The hydraulic motor 117 is connected through a shaft 123 to a generator 124, which serves for electrical recharging of a battery 125. If appropriate, two pumps 114 and 114*a*can be disposed in the main block 111 that is at ground potential. On one hand the pumps are adapted to the different requirements as to recharging of the reservoirs 118, 119 and 120 and on the other hand they are adapted to the drive of the hydraulic motor 117. The pumps may also be redundant so as to increase the reliability of the apparatus. Considerations with regard to increasing reliability by redundancy of individual components can naturally extend to other components.

The generator is preferably a dynamo, the size of which is small and which can then be associated with the block 110 that is at high-voltage potential.

I claim:

1. In a high-voltage switchgear having a fixed and a moving contact member, a hydraulic drive for operation of the moving contact member, comprising a piston and cylinder configuration having a piston coupled to the moving contact member, a fluid reservoir configuration supplying fluid under pressure to said piston for driving said piston, a compressor unit at ground potential for charging said fluid reservoir configuration, electrically-insulating, pressure-resistant lines respectively connecting said compressor unit with said piston and cylinder configuration and with said fluid reservoir configuration, said piston and cylinder configuration and said fluid reservoir configuration being disposed spatially close to and at the same electrical potential as the moving contact member, hydraulic actuators for said fluid reservoir configuration and for said piston, and an electronic control unit for setting said hydraulic actuators and for processing and transmitting control signals, said electronic control unit being spatially close to and at the same high-voltage potential as the moving contact member.

2. Hydraulic drive according to claim 1, including an electrical storage device being in spatial proximity to said electronic control unit and at high-voltage potential, for supplying power to said electronic control unit and for setting said said hydraulic actuators.

3. Hydraulic drive according to claim 2, wherein said electrical storage device is a battery.

4. Hydraulic drive according to claim 1, including a control energy supply unit at ground potential, means for directly transmitting energy for supplying said electronic control unit and for setting said hydraulic actuators as light energy from said control energy supply unit to high-voltage potential, and means at high-voltage potential for converting the light energy into electrical energy.

5. Hydraulic drive according to claim 1, including a control energy supply unit at ground potential, an electrically-insulating glass fiber cable transmitting energy for supplying said electronic control unit and for setting said hydraulic actuators as light energy from said control energy supply unit to high-voltage potential, and means at high-voltage potential for converting the light energy into electrical energy.

6. Hydraulic drive according to claim 2, including a control energy supply unit at ground potential, means for directly transmitting energy for supplying said electronic control unit, for setting said hydraulic actuators and for charging said electrical storage device as light energy from said control energy supply unit to high-voltage potential, and means at high-voltage potential for converting the light energy into electrical energy.

7. Hydraulic drive according to claim 2, including a control energy supply unit at ground potential, an electrically-insulating glass fiber cable transmitting energy for supplying said electronic control unit, for setting said hydraulic actuators and for charging said electrical storage device as light energy from said control energy supply unit to high-voltage potential, and means at high-voltage potential for converting the light energy into electrical energy.

8. Hydraulic drive according to claim 1, including a central control configuration at ground potential, and electrically insulating glass fiber cables for transmitting light signals generated by said central control configuration to said electronic control unit and for transmitting light signals generated by said electronic control unit to said central control configuration.

9. Hydraulic drive according to claim 1, including a central control configuration at ground potential, and means for directly transmitting light signals generated by said central control configuration to said electronic control unit across an electrically insulating gas gap and for directly transmitting light signals generated by said electronic control unit to said central control configuration across the electrically insulating gas gap.

10. Hydraulic drive according to claim 1, including a current sensor electrically conductingly connected to said said electronic control unit for controlling operations of the moving contact member triggered by said electronic control unit in time synchronization with current flow.

11. Hydraulic drive according to claim 1, including a conductor at high-voltage potential having an interior, said piston and cylinder configuration, said fluid reservoir configuration and said electronic control unit being disposed in said interior of said conductor.

12. Hydraulic drive according to claim 2, including a conductor at high-voltage potential having an interior, said piston and cylinder configuration, said fluid reservoir configuration, said electronic control unit and said electrical storage device being disposed in said interior of said conductor.

13. Hydraulic drive according to claim 5, including a conductor at high-voltage potential having an interior, said piston and cylinder configuration, said fluid reservoir configuration and said electronic control unit being disposed in said interior of said conductor, a metal casing surrounding said conductor, and a supporting insulator disposed between said conductor and said metal casing, said glass fiber cable being conducted through said supporting insulator from high-voltage potential to ground potential.

14. Hydraulic drive according to claim 8, including a conductor at high-voltage potential having an interior, said piston and cylinder configuration, said fluid reservoir configuration and said electronic control unit being disposed in said interior of said conductor, a metal casing surrounding said conductor, and a supporting insulator disposed between said conductor and said metal casing, said glass fiber cables being conducted through said supporting insulator from high-voltage potential to ground potential.

15. Hydraulic drive according to claim 7, including a conductor at high-voltage potential having an interior, said piston and cylinder configuration, said fluid reservoir configuration, said electric control unit and said electrical storage device being disposed in said interior of said conductor, a metal casing surrounding said conductor, and a supporting insulator disposed between said conductor and said metal casing, said glass fiber cable being conducted through said supporting insulator from high-voltage potential to ground potential.

16. Hydraulic drive according to claim 1, In a high-voltage switchgear having a fixed and a moving contact member, a hydraulic drive for operation of the moving contact member, comprising a piston and cylinder configuration having a piston coupled to the moving contact member, a fluid reservoir configuration supplying fluid under pressure to said piston for driving said piston, a compressor unit at ground potential for charging said fluid reservoir configuration, electrically-insulating, pressure-resistant lines respectively connecting said compressor unit with said piston and cylinder configuration and with said fluid reservoir configuration, said piston and cylinder configuration and said fluid reservoir configuration being disposed spatially close to and at the same electrical potential as the moving contact member, a conductor at high-voltage potential having an interior, said piston and cylinder configuration and said fluid reservoir configuration being disposed in said interior of said conductor, a metal casing surrounding said conductor, and a supporting insulator disposed between said conductor and said metal casing, said said electrically-insulating, pressure-resistant lines lines being in the form of a hydraulic pressure line and a return line conducted through said supporting insulator.

17. Hydraulic drive according to claim 1, wherein said fluid reservoir configuration includes a plurality of reservoirs corresponding to a given number of required switching actions.

18. Hydraulic drive according to claim 2, including an electric generator at high-voltage potential disposed spatially close to the moving contact member, a hydraulic motor at high-voltage potential driving said electric generator, said electrically-insulating, pressure-resistant lines lines carrying pressure fluid conveyed from ground potential to high-voltage potential driving said hydraulic motor and charging said electrical storage device.

19. Hydraulic drive according to claim 8, including a supporting insulator supporting said piston and cylinder configuration, said fluid reservoir configuration and said electronic control unit, and an insulating supply conduit parallel to said supporting insulator, said electrically-insulating, pressure-resistant lines lines and said electrically insulating glass fiber cables being disposed inside said insulating supply conduit.

* * * * *